US005145062A

United States Patent [19]

Crispi

[11] Patent Number: 5,145,062

[45] Date of Patent: Sep. 8, 1992

[54] PORTABLE TISSUE BOX HOLDER WITH INCORPORATED DISPOSABLE WASTE RECEPTACLE

[76] Inventor: James Crispi, P.O. Box 302, Washingtonville, N.Y. 10992

[21] Appl. No.: 744,304

[22] Filed: Aug. 13, 1991

[51] Int. Cl.[5] ..... B65D 81/00

[52] U.S. Cl. ..... 206/233; 206/457; 206/494

[58] Field of Search ..... 40/312; 206/44 B, 44 R, 206/233, 449, 457, 494; 220/737

[56] References Cited

U.S. PATENT DOCUMENTS

| | | | |
|---|---|---|---|
| 2,007,042 | 7/1935 | Duckett | 206/233 |
| 2,665,003 | 1/1954 | Feigelman | 206/457 |
| 2,841,275 | 7/1958 | Schwimmer et al. | 206/233 |
| 3,285,399 | 11/1966 | Snow | 206/44 R |
| 3,307,687 | 3/1967 | Steinman | 206/233 |
| 3,331,498 | 7/1967 | Davies | 206/494 |
| 3,845,858 | 11/1974 | Jenkins | 206/233 |
| 4,879,442 | 11/1989 | Giovine | 206/494 |
| 5,054,612 | 10/1991 | Meyer, Jr. | 206/233 |

*Primary Examiner*—Jimmy G. Foster
*Attorney, Agent, or Firm*—Sandra M. Kotin

[57] ABSTRACT

A portable holder for use with standard top-opening tissue boxes fitted with a disposable waste receptacle bag to receive soiled tissues. The holder is made from a single foldable paperboard blank, cut and scored in such manner as to be quickly assembled around the tissue box and affixed to it by means of a notched flap. A small kitchen plastic bag or paper lunch bag may be used as the waste receptable and is disposed of with the soiled tissues. The holder can contain a printed design on one side in the form of a clown, animal or other familiar figure whereby the opening for the mouth is the site of the waste receptacle and the arms encircle the tissue box. The illustration may also be of a familiar object, setting or an abstract design. The unique fold system maintains the printed design on the outside surface of the assembled holder.

11 Claims, 4 Drawing Sheets

PORTABLE TISSUE BOX HOLDER WITH INCORPORATED DISPOSABLE WASTE RECEPTACLE

FIELD OF THE INVENTION

The instant invention relates to a holder which attaches to a standard tissue box and is constructed to receive a disposable waste receptacle bag for the disposal of soiled tissues.

BACKGROUND OF THE INVENTION

Standard tissue boxes are completely portable and can be taken anywhere, including out-of-doors and into automobiles. Unless a waste receptacle is nearby there is the problem of the disposal of soiled tissues. Even when a waste basket is at hand there may be a problem reaching it or getting the soiled tissues into it. This is especially true when out-of-doors, in an automobile, for a very ill bed-ridden person or a young child. Several attempts have been made to provide a waste receptacle in close proximity to the tissue box, but most of these have been specifically for use in automobiles and are not portable units.

Constantine, in U.S. Pat. No. 3,026,999, provided a tissue container with a waste receptacle for mounting on the sun visor of an automobile. The container was designed specially for this purpose and was quite distinct from the standard boxes in which tissues are usually supplied.

Glovine, in U.S. Pat. No. 4,879,442, provided a waste compartment which was built into the tissue box. The compartment was separated from the fresh tissues by a movable partition which would move up as the fresh tissues were removed from the top of the box. The soiled tissues were inserted into the waste compartment through an opening in the bottom of the box. When all fresh tissues were used the entire box could be thrown away with the soiled tissues.

Faltine, in U.S. Pat. No. 3,072,245, designed a top-mounted holder which was made to contain a standard tissue box and a waste box. This holder was specifically designed to be permanently mounted to the underside of the dashboard of a vehicle. The waste box had to be emptied.

In U.S. Pat. No. 3,089,597, Kaplan designed a holder or carrier for a standard tissue box which also held an attached disposal container. This carrier was designed to be rigidly mounted below the dashboard of an automobile.

Jenkins, in U.S. Pat. No. 3,845,858, designed a container having two compartments which dispensed tissues from a bottom opening of one compartment while waste tissues could be placed in the top opening of the other compartment. The two compartments were separated by a fixed partition. This container was designed to be placed in restaurants and other public places for the disposal of chewing gum. The waste compartment had to be periodically emptied.

The present invention relates to a holder made of lightweight paperboard which is affixed to a standard tissue box and which is designed to be fitted with a waste receptacle container. The box plus holder is not further attached to anything and is therefore just as portable as the tissue box alone.

The tissue box and holder assembly may be taken anywhere the tissue box alone may be taken with the added convenience of the waste receptacle container.

Additionally, if a plastic or paper bag is used, the waste bag itself is totally disposable and easily replaced. There is no waste receptacle to be emptied. This provides for a more sanitary disposal.

BRIEF SUMMARY OF THE INVENTION

When a person is ill and confined to bed it is often difficult to dispose of soiled tissues without missing the waste basket, even if placed quite near the bed. This is especially true for very ill patients and young children. A box of tissues may also be taken many places where there is no waste basket. It is also characteristic of children to ignore a waste basket and simply drop soiled tissues on the floor or bedclothes.

It is the object of the present invention to provide a holder which can easily be affixed to a standard tissue box and which can easily be fitted with a waste receptacle bag to receive soiled tissues.

It is another object of the invention that the waste bag be disposable in and of itself so that there is no need to have contact with soiled tissues. There is no waste container to be emptied.

Another object of the invention is to have as the waste bag a small kitchen plastic bag or a simple paper lunch bag, either of which is easily obtainable and completely disposable.

It is a further object of this invention to have the holder illustrated in such a way as to compliment room decor and positively enhance the look of the tissue box.

A still further object of the present invention is to make the holder of inexpensive paperboard. The holder folds flat when not in use and can easily be stored in a drawer or cabinet. The holder is assembled and affixed to the tissue box in a matter of seconds. The holder will fit all standard tissue boxes having rectangular top and bottom surfaces. The design of the instant invention can easily be adapted to be used with tissue boxes having square top and bottom surfaces.

The present invention consists of a paperboard unit which is impressed with fold lines and has precut portions for ease of assembly. When properly assembled it encircles the standard tissue box. Notched ends of the encircling arms provide a means to lock the unit around the tissue box and a flap with notches interlocks with the opening in the top of the box to hold both components together and to maintain the holder in place when the assembly is lifted and moved.

Three sides of the holder are shorter than the height of the tissue box. The fourth side or back wall panel is taller and extends some distance above the top of the box, is slightly narrower than the width of the box, but widened toward the bottom by shoulders curving about the two back corners of the tissue box. This back wall panel contains the opening into which the waste bag is fitted and the notched flap which interlocks with the tissue box opening.

The holder is made of paperboard of about the same weight and stiffness as that of the standard tissue box. The holder may be decorated with a printed design. The design may compliment the tissue box itself, add to room decor or provide its own focal point. The latter is especially useful when the unit is used by children. A clown's face, animal face, that of a popular cartoon character, familiar object or setting or an abstract design, with the disposal opening at the mouth or other suitable position depending on the illustration chosen, will encourage children to put the soiled tissues in the waste receptacle bag. This serves to provide better sanitation and also to entertain a sick child. The illustration may be printed in colors or in black and white, the latter lending itself to being colored in with crayon, another means to involve a child in its use.

The holder may also be made of lightweight but rigid plastic or other polymeric material.

Since the waste disposal bag is relatively small, it will not take up much room, nor will it be so heavy as to make the assembled unit unbalanced. The waste bag is not emptied but is removed and disposed of with the soiled tissues and is easily replaced. This is utilitarian and provides for better sanitation, an important consideration in today's health conscious environment. When a paper bag is used as the waste receptacle, both it and the soiled tissues are biodegradable, and therefore conform to environmental concerns.

The illustration on the paperboard blank is printed on one side only. The unique fold system permits the arms to enclose the tissue box while maintaining the printing or illustration facing outward in full view. Thus the arms can be the Clown's or character's arms or the front legs of an animal or other suitable parts of the illustration which interlock in the front of the assembly giving the appearance that the figure is indeed holding the tissue box or that it is integrated into the illustration. The back wall panel is made slightly narrower than the width of the tissue box. The arms extend from slanted shoulders. When properly assembled the shoulders curve around the corners of the box. This curve puts tension on the holder and secures the tissue box more firmly then if right angle folds had been employed.

When a specific character is depicted, this curve of the shoulders also enhances the look of the character holding the box.

A preferred embodiment of this invention utilizes a clown's face and upper body as the illustration. The back wall panel contains two precut flaps. The upper flap or "mouth" is designed to fold backward. The flap is cut on three sides, leaving the top of the flap as a hinge such that the flap is pushed backward when a soiled tissue is inserted and falls back into place, partially covering the mouth opening when not in use. Slits on each side of the hinge anchor the plastic waste disposal bag in place. The two corners of the open end of the bag are easily inserted into the slits. When the soiled tissue is inserted into the mouth, it falls into the bag.

Another feature of the invention is the lower flap or "tie" which is also precut and which is folded outward. It is also cut all around except for two sections at the top of the flap which act as hinges. There are two sets of notches cut into this flap which serve to articulate with the sides of the opening in the top of a standard tissue box. Since different manufacturers make the openings of various sizes and distances from the side of the box, either set of notches may be selected to interlock with the opening provided. When this flap is interlocked with the opening in the top of the tissue box, the box is locked into the holder and thereafter will not slip out when the assembly is lifted and carried from place to place. A special tab cut into the top of this flap between the two hinge portions folds upright so that the lower open edge of the plastic disposal bag may be slipped over it. This helps secure the bag to the holder and also anchors the bottom edge so that when soiled tissues are placed into the "mouth" they fall into the bag and not onto the floor.

DETAILED DESCRIPTION OF THE INVENTION

Figure 1:
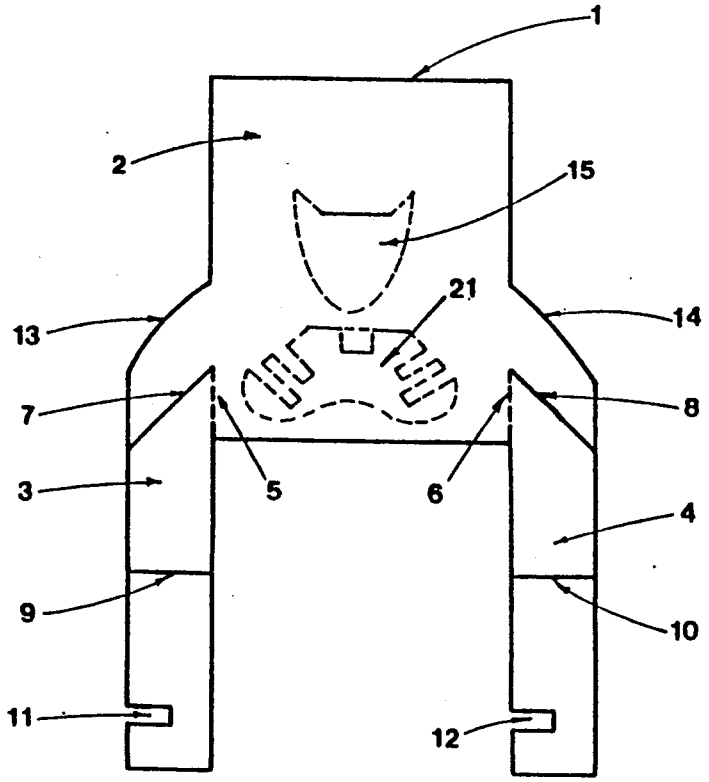
FIG. 1 is a plan view of the front of a cut and scored paperboard blank from which the tissue box holder is formed.
Figure 2:
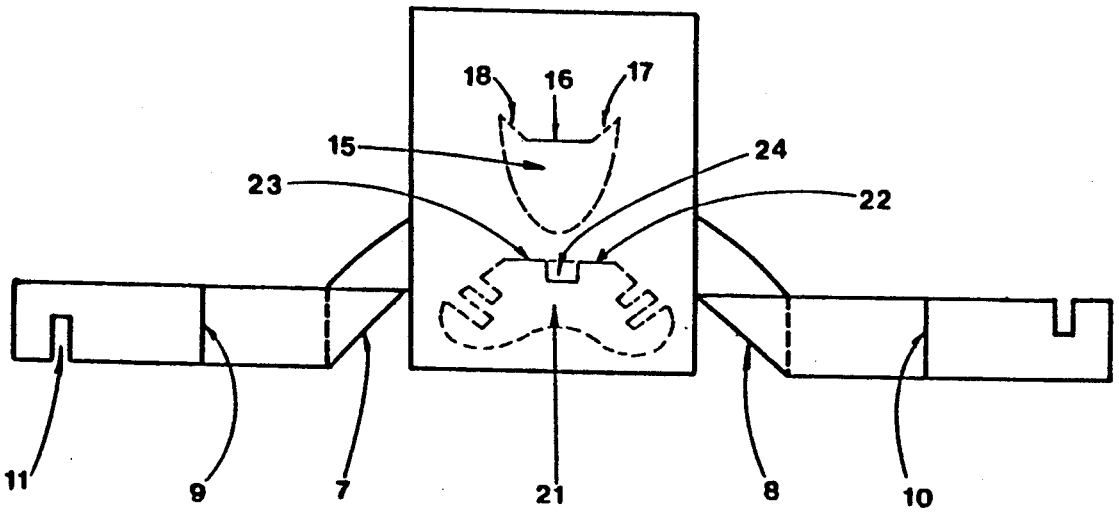
FIG. 2 is a front view of the holder in an upright position with the arm portions partially folded.
Figure 3:
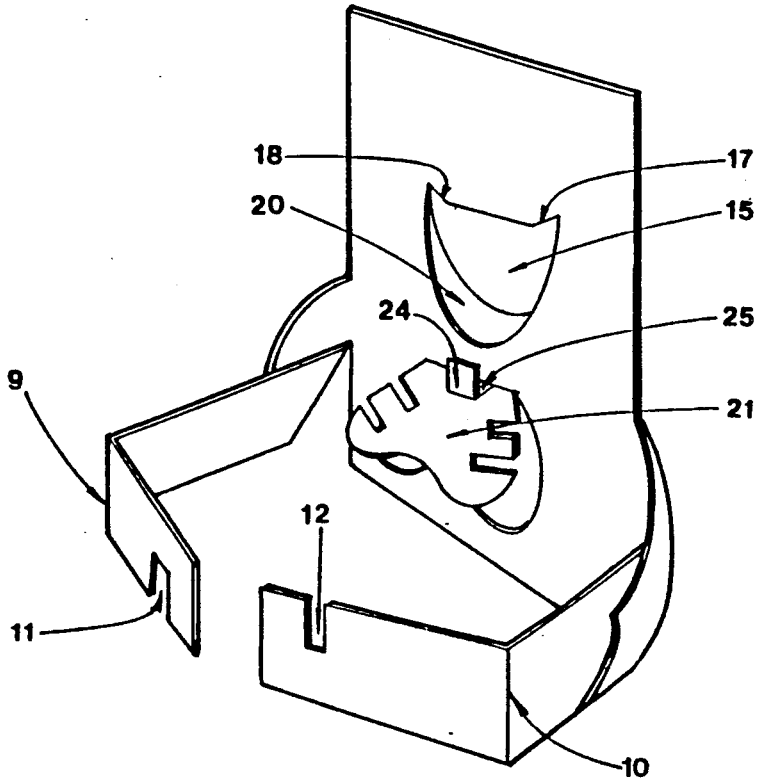
FIG. 3 is a perspective view of the holder with arm portions fully folded and ready to receive the tissue box. This view also clearly shows the opposing notches at the ends of the arms ready to be interlocked.
Figure 4:
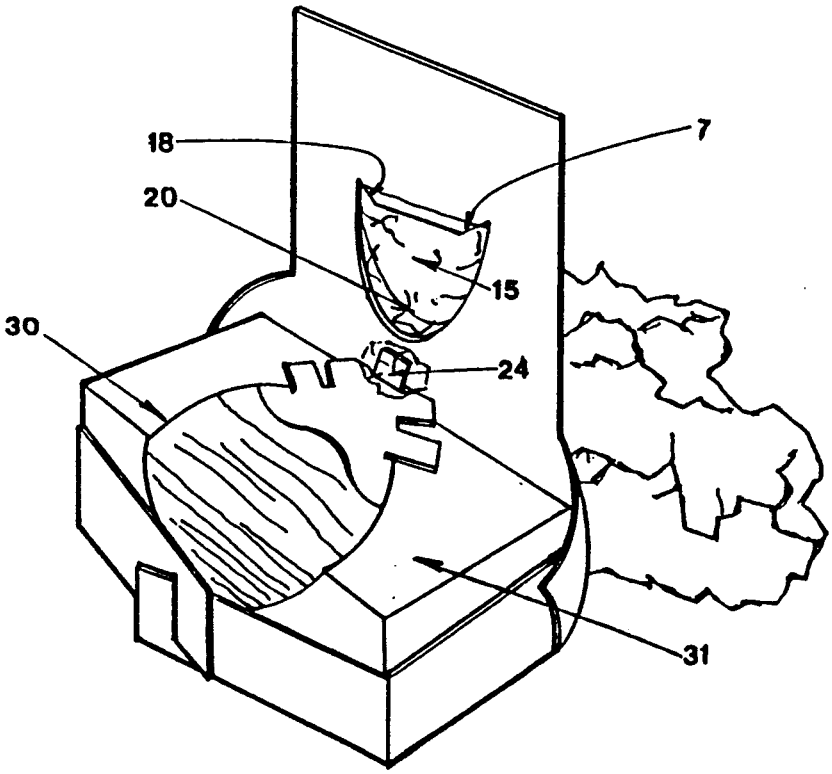
FIG. 4 is a perspective view of the fully assembled holder with the tissue box and waste receptacle bag in place.
Figure 5:
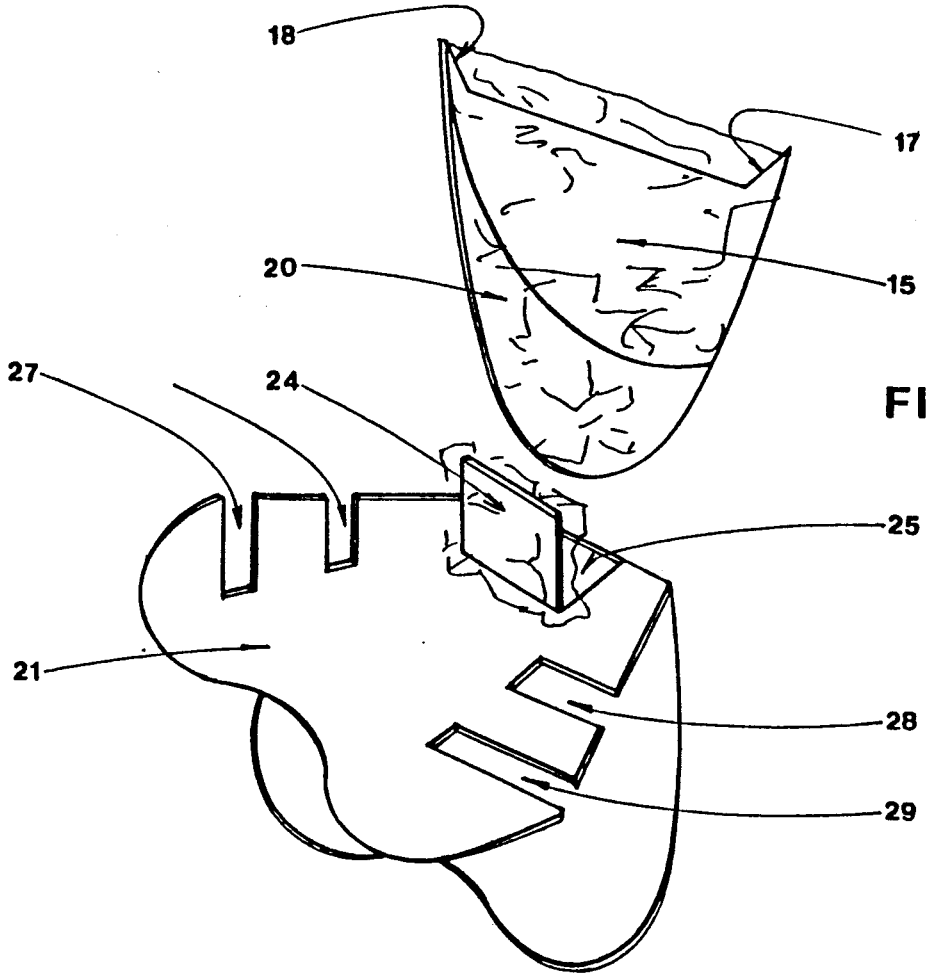
FIG. 5 is a close-up view of the two flap sections showing the two slits receiving the corners of the waste receptacle bag, the lower tab anchoring the bottom edge of the bag-opening and the two sets of notches for interlocking with the opening in the top of the tissue box.
Figure 6:
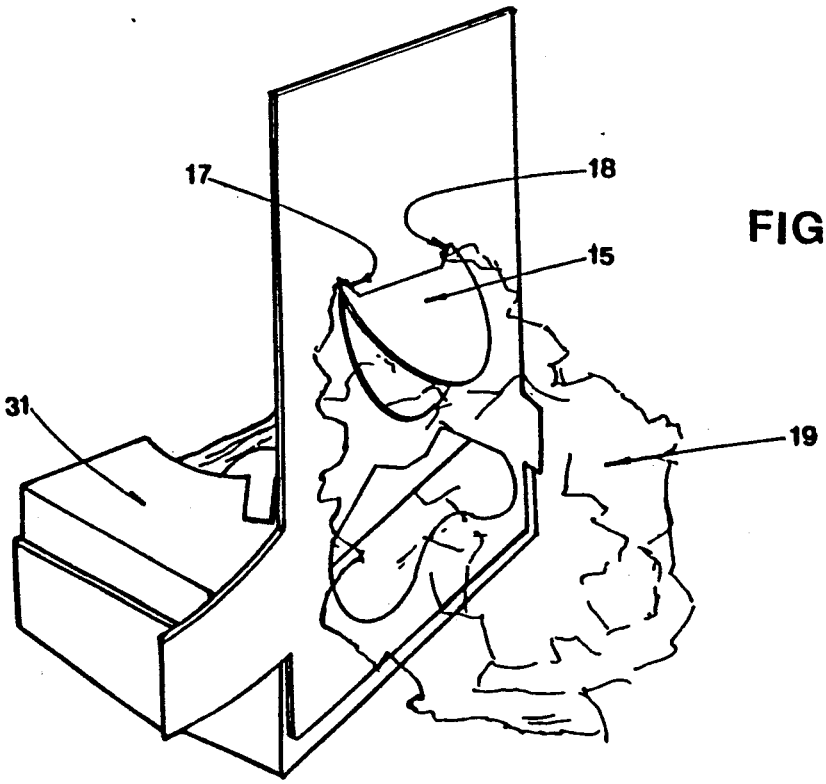
FIG. 6 is a perspective rear view of the assembly showing how the waste receptacle bag is positioned.
Figure 7:
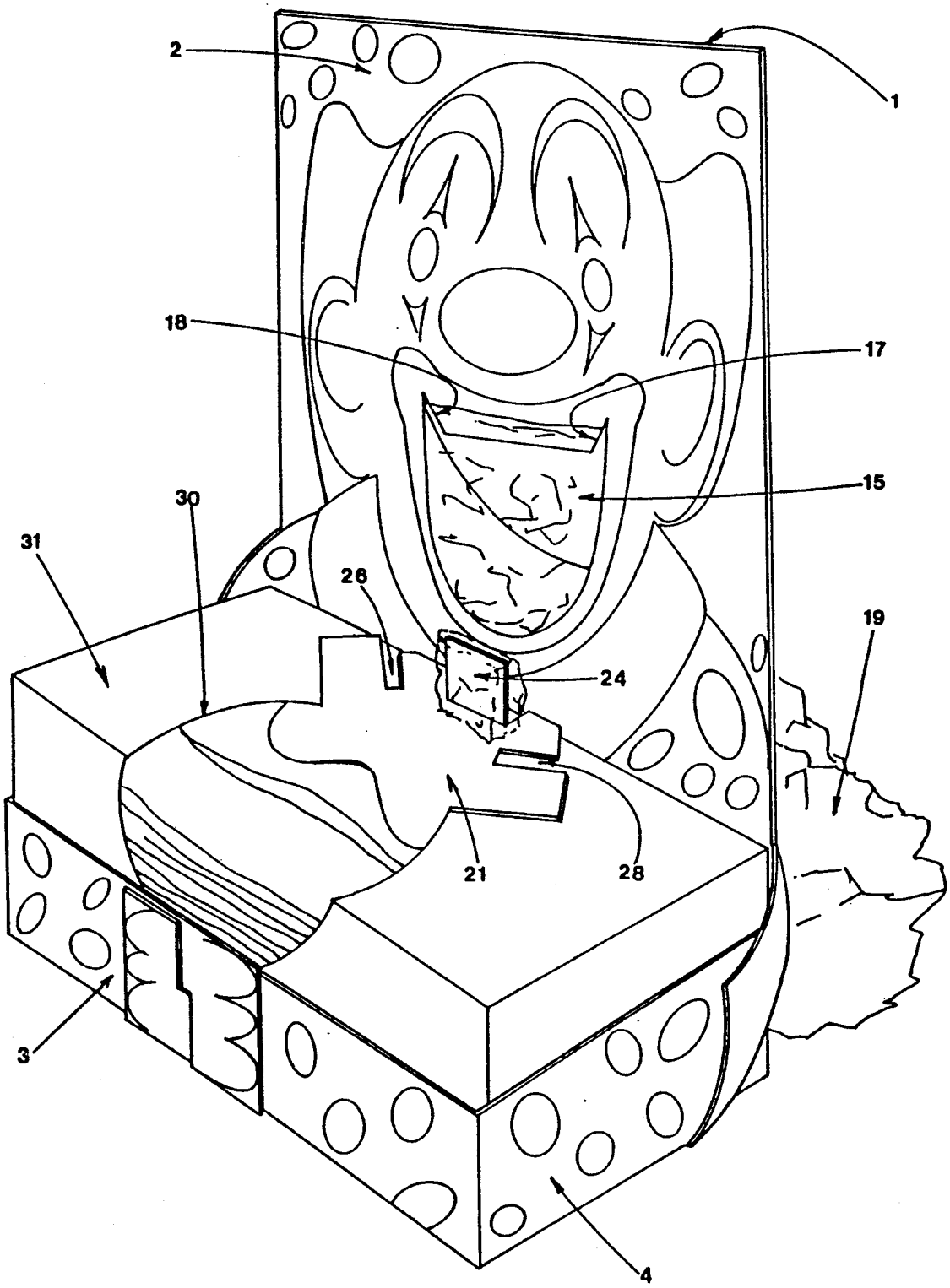
FIG. 7 is a perspective view of a preferred embodiment showing a clown's face with tissue box and waste receptacle bag in place.

The invention consists of a single paperboard blank 1, cut and scored in such manner that all fold lines are clearly delineated and all flaps, slits, tabs and notches are cut completely through for ease and speed of assembly. The blank 1 includes a back wall panel 2 with two arms 3 and 4 integrated with the back wall panel 2 along its opposing lower side edges and extending well below its bottom edge. The top portion of each arm, forming shoulders 13 and 14, is slanted downward from the back wall panel 2. The lower edges of the back wall panel contiguous with the arms are cut forming slits 5 and 6 on each side of the back wall panel which separate said lower edges from the arms. Scored fold lines 7 and 8 extend downward from the tops of slits 5 and 6 to the outer edges of the arms 3 and 4 and are at 45° angles.

Further down each arm are horizontal scored fold lines 9 and 10. Near the end of each arm, on the left edge are notches 11 and 12. When the arms are folded along the two fold lines, the ends can be brought together by interlocking notches 11 and 12, which are now on opposing sides of the arms. The holder is thereafter ready to receive the tissue box.

There are two precut flaps in the back wall panel 2. The upper flap 15 is cut all around except for the top portion 16 which acts as a hinge. There are two slits 17 and 18, one at each opposing side of the hinge 16. These slits serve to anchor the corners of the plastic waste receptacle bag 19. When disposing of soiled tissues, flap 15 is pushed backward uncovering the opening 20. When not so engaged, flap 15 falls back into place and covers the opening.

The lower flap 21 is cut all around except for two sections 22 and 23, on each side of the upper edge. These two sections act as hinges for the lower flap 21 which is pushed forward. Between hinges 22 and 23 is a cut out tab 24 which bends outward and stands upright forming an opening 25. The lower edge of the opening of the waste receptacle bag 19 is pulled through opening 25 and looped over tab 24. This serves to secure that part of the bag in place and prevent tissues from falling through to the floor. Two sets of notches, 26 and 28, and 27 and 29, are cut into flap 21 to articulate with the sides of the opening 30 in the top of a standard tissue box 31. The set of notches selected will depend upon the size and position of opening 30. The two sets of notches are provided to accommodate the various top openings found in standard tissue boxes.

To assemble the tissue box holder, the arms are folded along the fold lines 7, 8, 9 and 10. Flap 15 is pushed backward and folded slightly at the hinge 16. Flap 21 is pushed forward and outward and folded at the hinge portions 22 and 23. Tab 24 is brought upright. Arms 3 and 4 are brought around the tissue box 31 and connected by interlocking notches 11 and 12. Thereafter, the proper set of notches (26 and 28 or 27 and 29) is articulated with the sides of opening 30 in the top of the tissue box 31.

If a plastic bag is to be used as the waste receptacle, the bag is opened and the opposing corners of the opening are slipped into slits 17 and 18 from the back side of the back wall panel 2 but in front of the flap 15. The center of the lower edge of the bag opening is pushed through opening 25 and looped up and over tab 24. The assembly may now be carried by holding the box or the back wall panel. Soiled tissues may be disposed of directly into the waste receptacle bag by pushing against flap 15 which is visible through the plastic bag and dropping them into opening 20. The tissues will fall directly into the bag 19. Since flap 15 rests behind the plastic bag it remains clean and sanitary.

If a paper lunch bag is to be used as the waste receptacle bag, ½ inch to 1 inch of the rim of the bag should be folded over. The bag is then opened slightly and inserted into opening 20 from the front, at the same time pushing flap 15 backward and out of the way. The folded edge of the paper bag will hold it in place, but flap 15 is now out of the way and the "mouth" is wide opened with no flap to close over it. Tab 24 is not used with a paper bag.

Since many changes and variations of the instant invention may be made while keeping within its inventive concept, it is not intended to limit the invention except as required by the claims herein.

I claim:

1. A tissue box holder comprising a box-holding frame which encircles the tissue box, three sides of which are shorter than the height of the tissue box, and the fourth side is taller than the height of the tissue box and contains an aperture into which a waste receptacle container is affixed and a notched flap which articulates and interlocks with the sides of the opening of the tissue box so as to affix the frame to the box.

2. A tissue box holder formed from a single blank, said holder comprising front and back walls integrated with opposing side walls; the front wall being formed by the interconnection of two oppositely notched arms; with said back wall extending above the top of the tissue box and containing an aperture formed by an upper hinged precut flap, the opposing sides of which contain slits to receive a waste receptacle container, which flap extends backward; and a lower hinged pre-cut flap which extends forward and contains a plurality of notches which articulate and interlock with the sides of the opening in the top of the tissue box.

3. A tissue box holder formed from a single blank of foldable paperboard and comprising:

(a) a large back wall panel taller than the height of the tissue box, narrower than the width of the tissue box and containing
  (1) An aperture formed by a pre-cut flap designed to fold backward along a scored fold line, the opposing sides of which contain slits to receive a flexible waste receptacle bag,
  (2) a lower pre-cut flap designed to fold outward along a scored fold line and having a plurality of notches which can articulate and interlock with the sides of the top opening of the tissue box and having a small tab cut from the fold line which stands upright and over which is folded the bottom edge of the waste receptacle bag; and (b) arms extending by downward slanting shoulders from the lower portion of each side of the back wall panel and continuing well beyond the lower edge of said back wall panel and being partially detached from said back wall panel by means of slits in the lowermost portion on each side contiguous with the back wall panel and each arm containing
  (1) a scored fold line extending downward from the top of the said slit to the outer edge of the arm at a 45° angle,
  (2) a horizontal scored fold line further down the length of the arm, and
  (3) a notch cut into the left edge near its end such that when the arms are properly folded they encircle the tissue box and the now oppositely placed notches interconnect to close the holder around the box.

4. A tissue box holder as in claim 3 which is printed with an illustration on the front only.

5. A tissue box holder as in claim 4 wherein the illustration is that of a clown's face and arms.

6. A tissue box holder as in claim 4 wherein the illustration is that of a familiar cartoon character.

7. A tissue box holder as in claim 4 wherein the illustration is that of an animal's face and front legs.

8. A tissue box holder as in claim 4 wherein the illustration is that of a familiar design or setting.

9. A tissue box holder as in claim 4 wherein the illustration is an abstract design.

10. A tissue box holder as in claim 3 made of lightweight but rigid polymeric material.

11. A tissue box holder as in claim 3 made of lightweight but rigid plastic.

* * * * *